US007198082B2

(12) United States Patent
Chuang

(10) Patent No.: US 7,198,082 B2
(45) Date of Patent: Apr. 3, 2007

(54) ADJUSTING DEVICE FOR THE ANGLE BLOCKING PLATE OF A PLANING MACHINE

(76) Inventor: Bor-Yann Chuang, No. 78, Yungfeng Rd., Taiping Shiang, Taichung (TW) 411

( * ) Notice: Subject to any disclaimer, the term of this patent is extended or adjusted under 35 U.S.C. 154(b) by 63 days.

(21) Appl. No.: 10/995,438

(22) Filed: Nov. 24, 2004

(65) Prior Publication Data

US 2006/0107813 A1 May 25, 2006

(51) Int. Cl.
*B27B 27/08* (2006.01)
*B27C 1/12* (2006.01)

(52) U.S. Cl. ..... 144/253.8; 144/286.5; 269/303

(58) Field of Classification Search ..... 144/114.1, 144/117.1, 253.5–253.9, 286.5; 409/229; 269/289 R, 318, 303, 315; 83/438, 468.7, 83/522.21, 477.2

See application file for complete search history.

(56) References Cited

U.S. PATENT DOCUMENTS

| | | | | |
|---|---|---|---|---|
| 381,752 | A * | 4/1888 | Beach | 83/438 |
| 2,872,957 | A * | 2/1959 | Eschenburg | 144/253.8 |
| 5,533,557 | A * | 7/1996 | Jedlicka et al. | 144/253.8 |
| 6,026,870 | A * | 2/2000 | Liu | 144/253.8 |
| 6,467,516 | B1 * | 10/2002 | Liao | 144/253.8 |

* cited by examiner

*Primary Examiner*—Shelley Self
(74) *Attorney, Agent, or Firm*—Troxell Law Office PLLC

(57) ABSTRACT

An adjusting device for the angle blocking plate of a planing machine includes a material conveying table having one side provided with a hand wheel. A worm has its outer end connected with the hand wheel and its inner end meshed with the worm gear of a transmission rod that is vertically and axially fitted with a fundamental base. The transmission rod has its upper gear portion extending out of the topside of the fundamental base and meshed with a lengthwise rack secured at the underside of an upper holding frame to be driven to move together. By so designing, the hand wheel can be turned around to quickly and precisely adjust the angle blocking plate to move forward and backward.

5 Claims, 6 Drawing Sheets

ADJUSTING DEVICE FOR THE ANGLE BLOCKING PLATE OF A PLANING MACHINE

BACKGROOUND OF THE INVENTION

1. Field of the Invention

This invention relates to an adjusting device for the angle blocking plate of a planing machine, particularly to one able to adjust the angle blocking plate of a planing machine to shift forward and backward by a hand wheel.

2. Description of the Prior Art

Generally, a conventional planing machine includes a material conveying table having one side connected with a fundamental base. An upper holding frame able to slide forward and backward is disposed on the fundamental base and connected thereon with an angle blocking plate able to slide forward and backward together with the upper holding frame on the material conveying table and provided for positioning a wood material during planing work.

However, to shift forward and backward, the upper holding frame and the angle blocking plate of the conventional plane machine have to be pushed and pulled manually or with the help of tools; therefore, it needs to take much exertion ad time to move them forward and backward and it can hardly control them to move precisely by hand.

SUMMARY OF THE INVENTION

The objective of the invention is to offer an adjusting device for the angle blocking plate of a planing machine, having a hand wheel assembled at one side of a fundamental base connected with the material conveying table of a plane machine. The hand wheel is connected with a worm that meshes with the worm gear of a transmission rod and actuates it to rotate. The transmission rod is vertically and axially fitted with the fundamental base, having its upper end formed with a gear extending out of the upper side of the fundamental base and meshed with a rack provided at the lower side of the upper holding frame and positioned in a lengthwise direction. Thus, when the hand wheel at one side of the fundamental base is rotated, the upper holding frame and the angle blocking plate can be quickly moved forward and backward.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
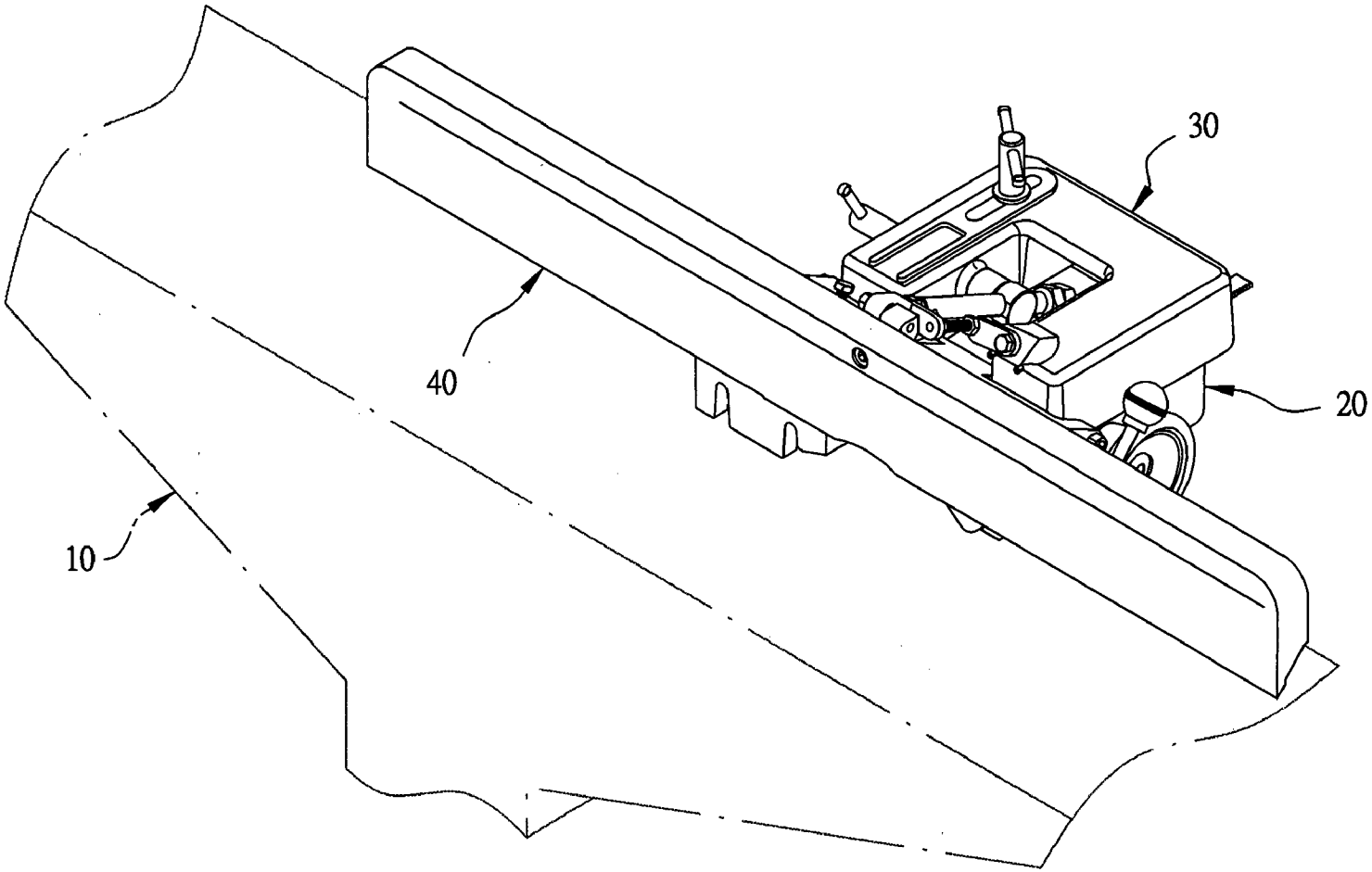
FIG. 1 is a partial perspective view of an adjusting device for the angle blocking plate of a plane machine in the present invention.
Figure 2:
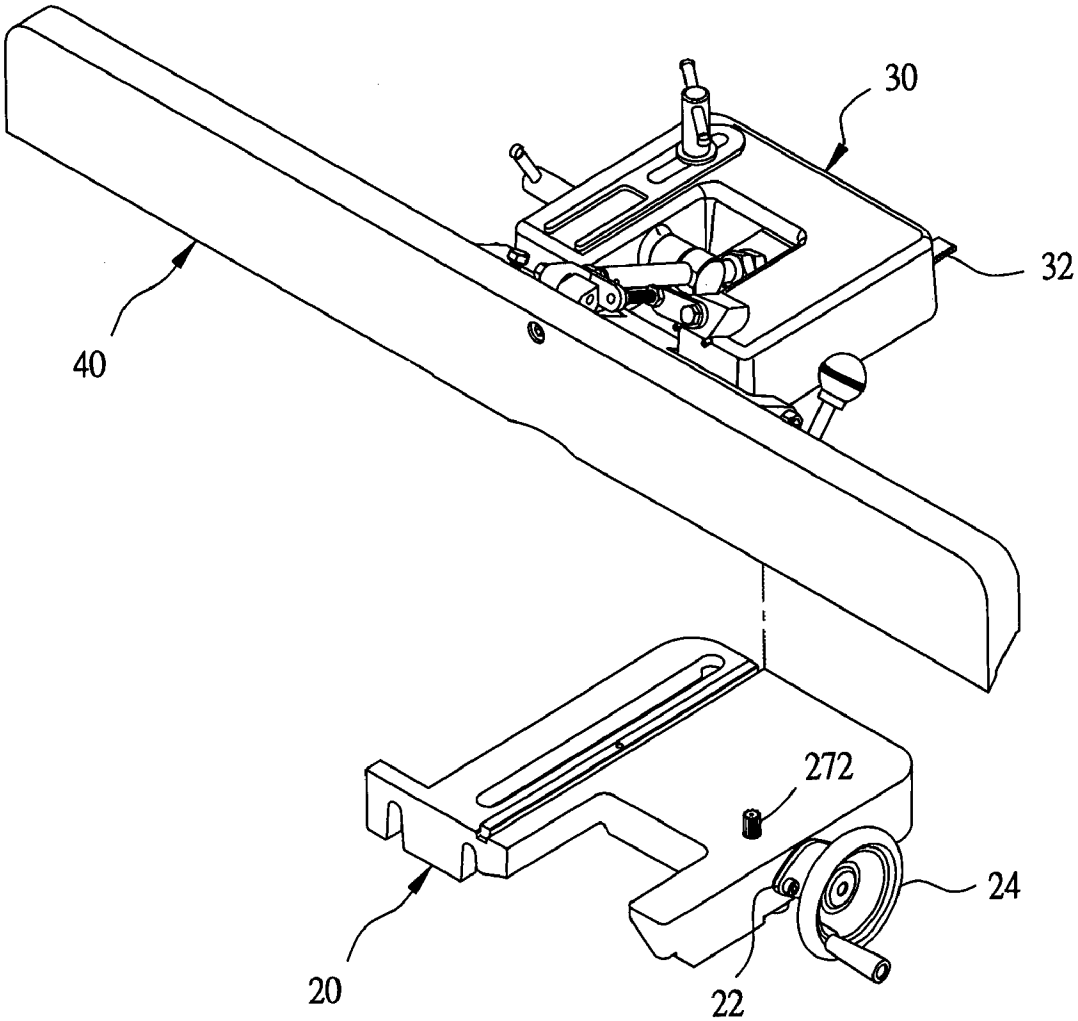
FIG. 2 is a partial exploded perspective view of the adjusting device for the angle blocking plate of a planing machine in the present invention.

A preferred embodiment of an adjusting device for the angle blocking plate of a planing machine in the present invention, as shown in FIGS. 1 and 2, includes a material conveying table 10, a fundamental base 20, an upper holding frame 30 and an angle blocking plate 40 combined together. The fundamental base 20 is connected at one side of the material conveying table 10. The upper holding frame 30 is disposed on the fundamental base 20, able to be guided to move forward and backward. The angle blocking plate 40 is connected with the upper holding frame 30, able to be moved forward and backward together with the upper holding frame 30 on the material conveying table 10 for positioning a wood material during carrying out planing work.

Figure 3:
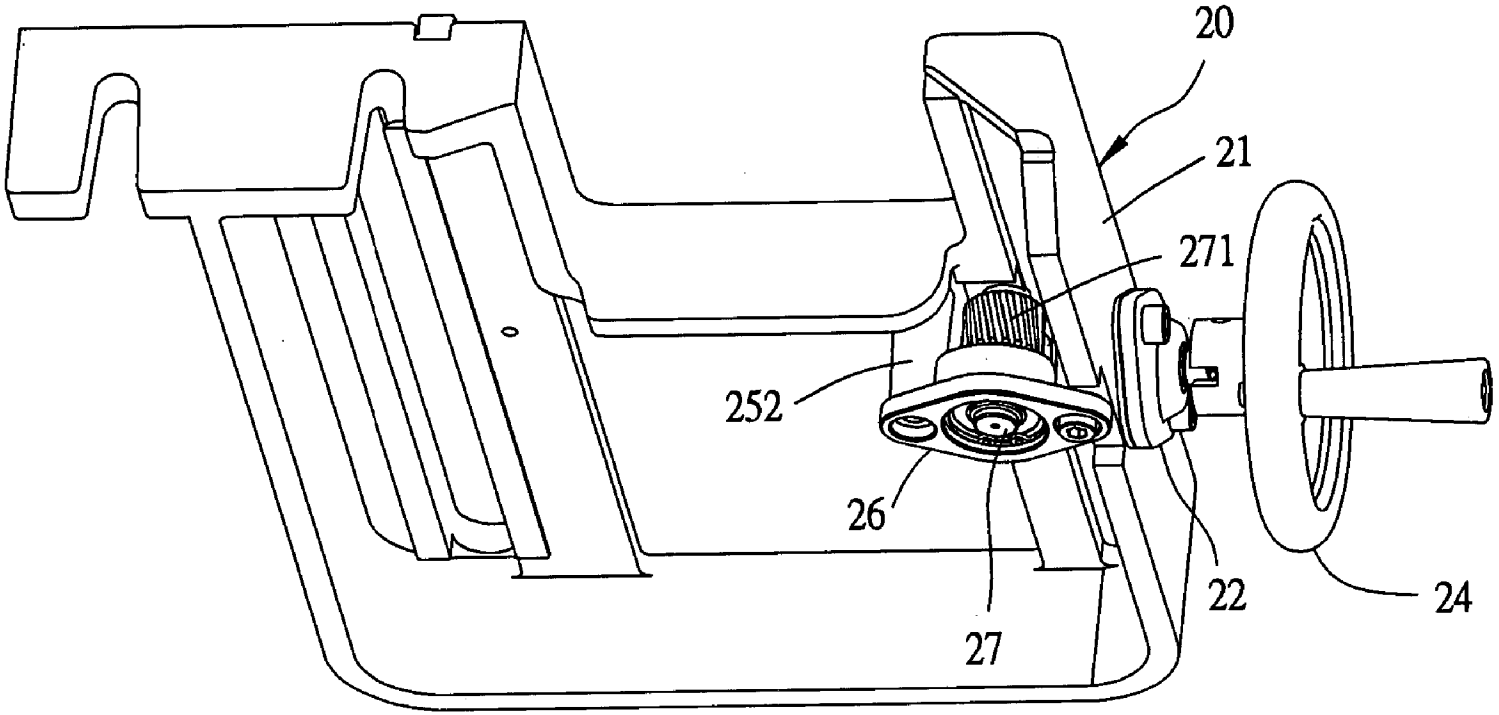
FIG. 3 is a perspective view of the underside of the fundamental base of the planing machine in the present invention.
Figure 4:
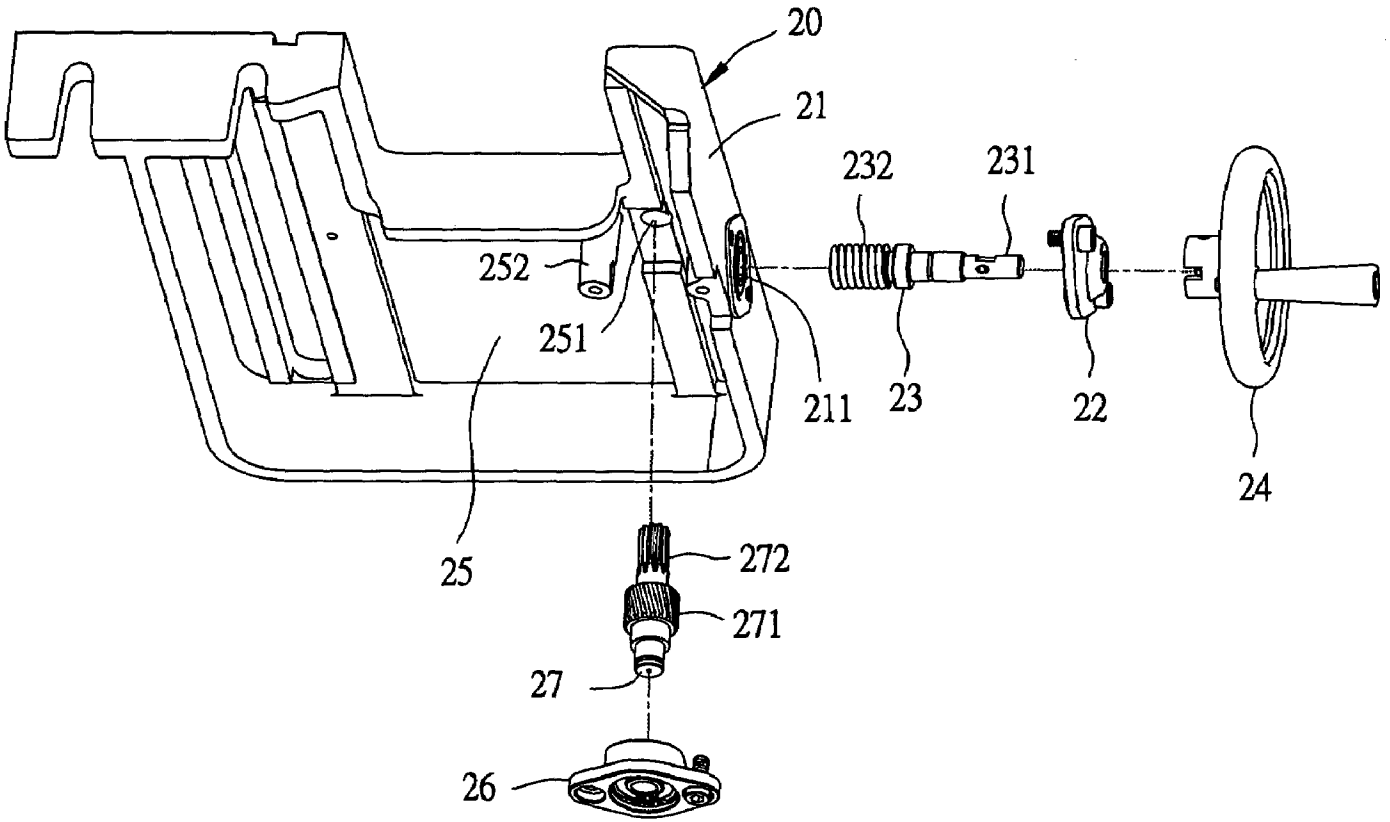
FIG. 4 is an exploded perspective view of the under side of the fundamental base of the planing machine in the present invention.
Figure 5:
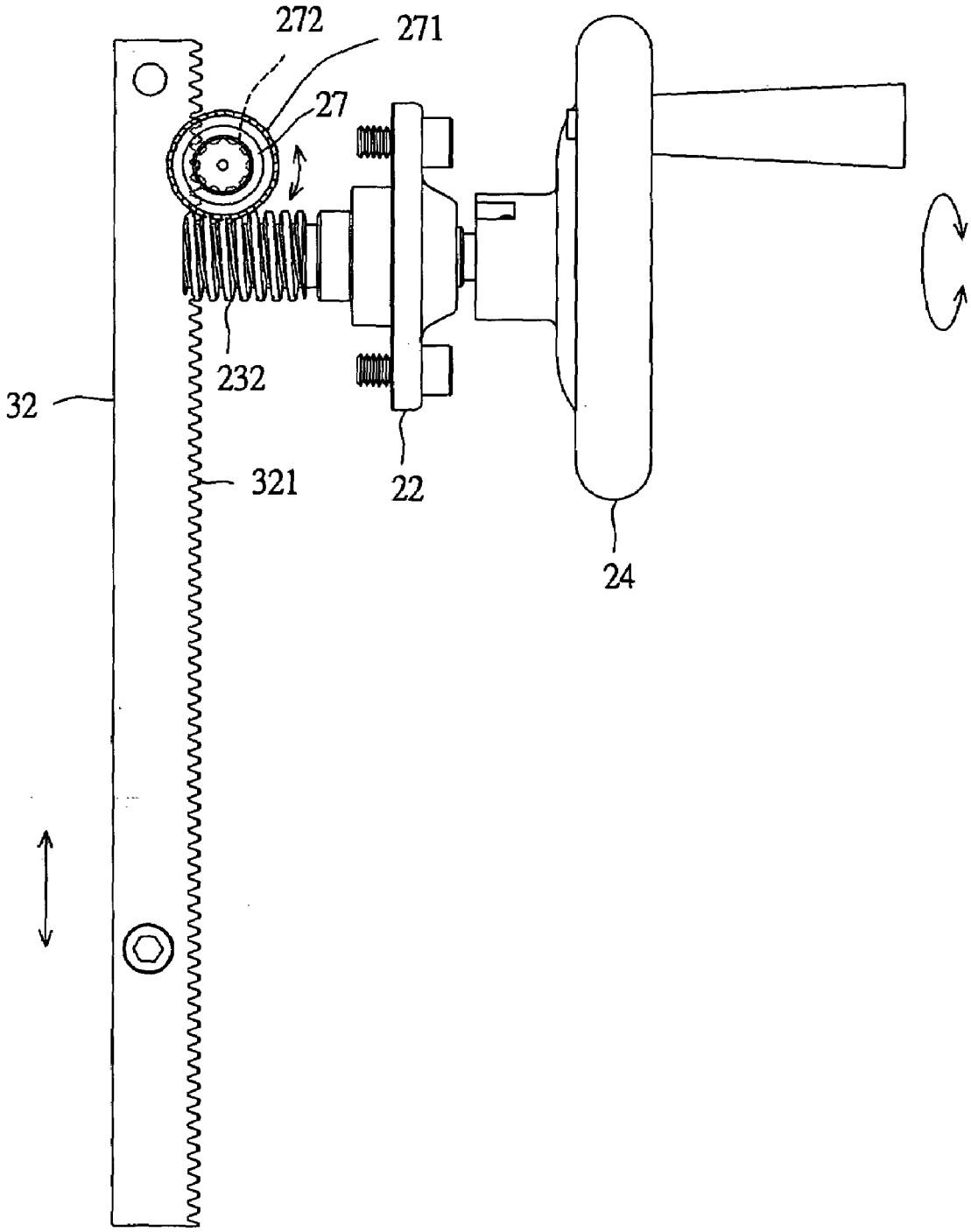
FIG. 5 is an upper view of the hand wheel and the rack of the adjusting device in a mutual operating condition in the present invention.

The fundamental base 20, as shown in FIGS. 3, 4 and 5, has one side plate 21 bored with a through hole 211 at a proper location and has a bearing case 22 correspondingly secured on the outer wall of the through hole 211 for a positioning rod 231 at the outer end of a worm 23 to be inserted outward therethrough and axially positioned on the bearing case 22. The positioning rod 231, after inserted through the bearing case 22, is firmly fitted with a hand wheel 24, and the worm 23 has its inner end formed with a worm portion 232. Further, the fundamental base 20 has its top plate 25 bored with a through hole 251 at a portion near the hand wheel 24 and the top plate 25 has its underside wall fixed at a proper position with a cylindrical connecting member 252 extending downward. A bearing case 26 is secured between the cylindrical connecting member 252 and the underside edge of the side plate 21 and positioned under the through hole 251 for axially receiving the lower end of a transmission rod 27 that has its intermediate portion formed with a worm gear 271 meshed with the worm portion 232 of the worm 23 and its upper end formed with a gear portion 272 inserted upward through the through hole 251 of the top plate 25 and extending out of the topside of the fundamental base 20.

Figure 6:
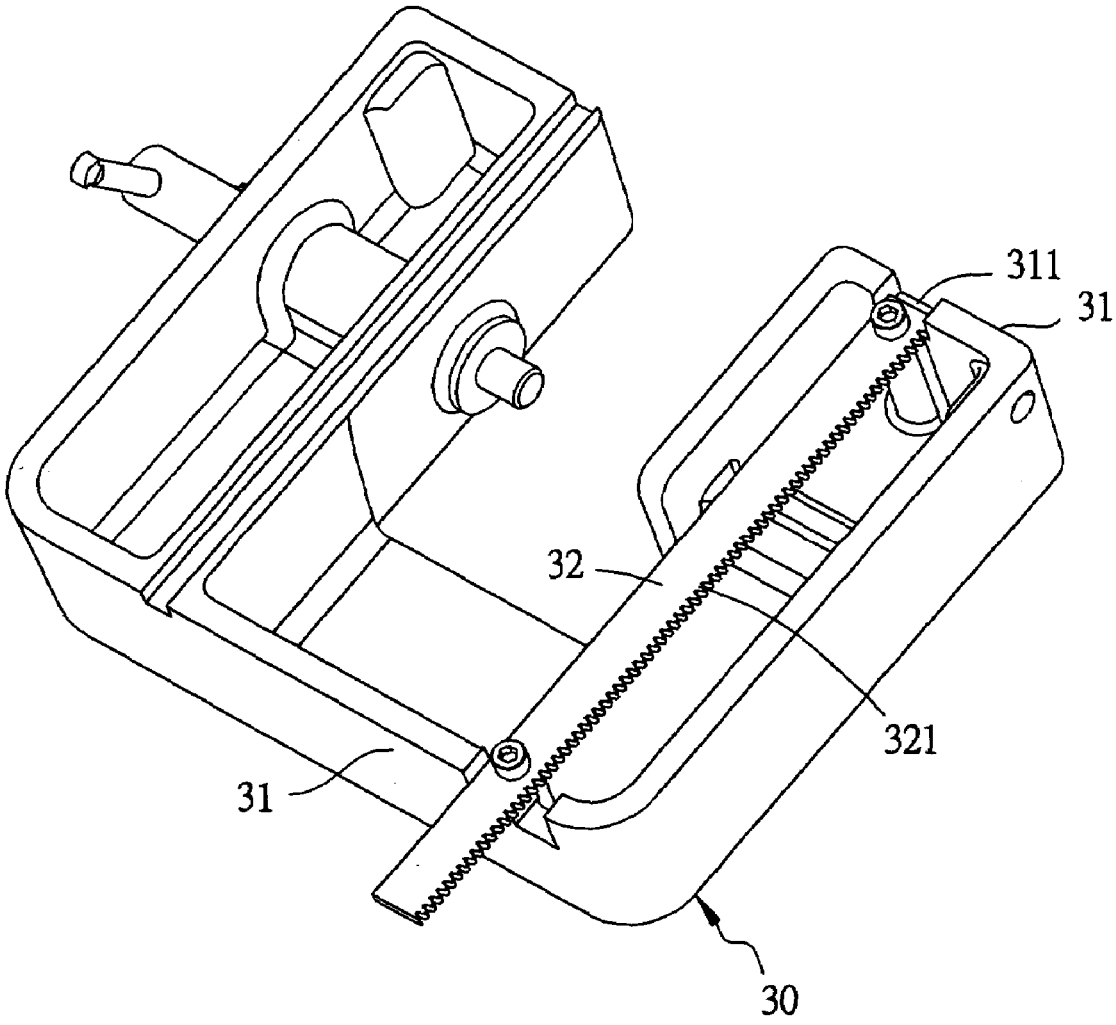
FIG. 6 is a perspective view of the underside of the upper holding frame of the planing machine in the present invention.

The upper holding frame 30, as shown in FIG. 6, has the underside wall of its front and rear side plate 31 respectively bored with a receiving recess 311 aligned to each other for firmly receiving the opposite ends of a elongate rack 32 that has one edge formed with numerous rowed teeth 321 exactly meshed with the gear portion 272 of the transmission rod 27 extending out of the topside of the fundamental base 20.

In operating, referring to FIG. 5, a wood material to be planed is first placed on the material conveying table 10. Then, the hand wheel 24 at one side of the fundamental base 20 is properly turned around to actuate the rack 32 fixed at the underside of the upper holding frame 30 to move linearly and synchronously actuate the upper holding frame 30 together with the angle blocking plate 40 to move forward and backward properly through the interaction of the worm portion 232 of the worm 23, and the worm gear 271 and the gear portion 272 of the transmission rod 27. Thus, the wood material leaning against the angle blocking plate 40 can be adjusted to proper position for planing, able to be operated quickly, precisely and with less energy and elevating the efficiency of planing.

While the preferred embodiment of the invention has been described above, it will be recognized and understood that various modifications may be made therein and the appended claims are intended to cover all such modifications that may fall within the spirit and scope of the invention.

I claim:

1. An adjusting device for an angle blocking plate of a planing machine comprising: a material conveying table, said material conveying table having one side connected with a fundamental base, said fundamental base having a topside assembled with an upper holding frame connected with an angle blocking plate, said angle blocking plate able to move forward and backward together with said upper holding frame on said material conveying table, said angle blocking plate provided for positioning a wood material during planning;

said fundamental base having a side inserted transversely by a worm, said worm having an outer end connected with a hand wheel, said worm having an inner end formed with a worm portion, a transmission rod vertically and axially secured at a predetermined location under said fundamental base, said transmission rod having an intermediate portion formed with a worm portion, said worm portion of said transmission rod meshed with said worm portion of said worm, said transmission rod having an upper end formed with a gear portion extending out of the topside of said fundamental base; and said upper holding base having an underside secured with a lengthwise rack at a predetermined location, said rack meshed with said gear portion of said transmission rod, which extends out of the topside of said fundamental base, said hand wheel turned around to actuate said worm and said transmission rod to rotate together, said worm and said transmission rod actuating said upper holding frame and said angle blocking plate to move forward and backward.

2. The adjusting device for the angle blocking plate of a planing machine as claimed in claim 1, wherein said fundamental base has one side plate bored with a through hole for a position rod at the outer end of said worm inserted outward therethrough and then connected with said hand wheel, with a bearing case fixed at the outer wall of said through hole, said bearing case provided for axially receiving said positioning rod of said worm.

3. The adjusting device for the angle blocking plate of a planing machine as claimed in claim 1, wherein said fundamental base has a top plate bored with a through hole said gear portion at the upper end of said transmission rod to be inserted therethrough, a bearing case fixed under said through hole of said fundamental base, said bearing case provided for axially receiving the lower end of said transmission rod.

4. The adjusting device for the angle blocking plate of a planing machine as claimed in claim 1, wherein said upper holding frame has an underside wall having a front and rear side respectively bored with a receiving recess for fixing opposite ends of said rack.

5. The adjusting device for the angle blocking plate of a planing machine as claimed in claim 4, wherein said rack has one preset edge formed with a row of teeth meshing with said gear portion at the upper end of said transmission rod.

* * * * *